US005163670A

United States Patent [19]

Sellers et al.

[11] Patent Number: 5,163,670

[45] Date of Patent: Nov. 17, 1992

[54] DUAL BIN PAPER FEED TRAY FOR AN IMAGE REPRODUCTION MACHINE SUCH AS A PRINTER OR COPIER

[75] Inventors: Charles A. Sellers; David P. Eichberger, both of Houston; Steven J. Lau, Tomball; Mark H. Ruch, Spring; Nicholas G. Forlenza, Cypress; Roger Q. Paulsel, Houston, all of Tex.

[73] Assignee: Compaq Computer Corporation, Houston, Tex.

[21] Appl. No.: 816,813

[22] Filed: Jan. 3, 1992

Related U.S. Application Data

[63] Continuation-in-part of Ser. No. 664,407, Mar. 4, 1991, Pat. No. 5,085,421.

[51] Int. Cl.[5] ..... B65H 1/12

[52] U.S. Cl. ..... 271/157; 271/160; 271/164; 271/170

[58] Field of Search ..... 271/157, 160, 170, 164

[56] References Cited

U.S. PATENT DOCUMENTS 5,100,122 3/1992 Noda ..... 271/157 X 5,102,112 4/1992 Takahashi ..... 271/157 X

*Primary Examiner*—Richard A. Schacher

*Attorney, Agent, or Firm*—Konneker & Bush

[57] ABSTRACT

A dual bin paper feed tray is removably insertable into the standard height tray-receiving housing opening of an image reproduction machine such as a printer or copier. The tray has adjacent front and rear paper holding bin areas each configured to hold a stack of approximately 250 cut paper sheets, the overall tray thus being adapted to hold the entire contents of a standard one ream package of cut paper sheets. In operation, the loaded tray is inserted, front end first, into the housing opening and the machine's paper feed system operates to sequentially feed paper sheets from the front tray bin into the machine. When the machine's paper sensing system detects that the front bin has been emptied, a shift structure incorporating a motor-driven gear train and associated cam/follower apparatus is automatically operated to move the rear paper stack into the front tray bin for infeed to the machine.

15 Claims, 10 Drawing Sheets

DUAL BIN PAPER FEED TRAY FOR AN IMAGE REPRODUCTION MACHINE SUCH AS A PRINTER OR COPIER

CROSS-REFERENCE TO RELATED APPLICATION

This application is a continuation-in-part of copending U.S. application Ser. No. 664,407 filed on Mar. 4, 1991 now U.S. Pat. No. 5,085,421.

BACKGROUND OF THE INVENTION

1. Field of the Invention

The present invention relates generally to image reproduction machinery, and more particularly relates to paper feed apparatus for printers, copiers and the like.

2. Description of Related Art

Modern image reproduction machines, such as printers and copiers, are typically provided with one or more paper supply trays, each of which is removably insertable into an associated opening formed in the outer housing of the machine. Each tray is adapted to hold a stack of cut paper sheets-typically of 8½"×11" or 8½"×14" size-for infeed to the internal printing portion of the machine and subsequent discharge from the machine housing into an external paper receiving structure.

Cut paper sheet stock of this type is typically sold in individually wrapped one ream packages (one ream being 500 sheets), and paper trays for printers and copiers are conventionally sized to hold a maximum of 250 sheets—i.e., half of the usual one ream package. Particularly in larger printing or copying "runs" it would be desirable to increase the sheet holding capacity of paper supply trays (preferably to a size capable of holding an entire one ream package of cut paper sheets) to reduce the frequency of manually reloading the tray.

One previously proposed method of permitting the operative loading of an entire one ream package into a paper feed tray has been to simply double the paper receiving and storage depth of the tray so that it is capable of holding a 500 sheet stack instead of the usual 250 sheet stack. While at first glance this seems to be a logical, straightforward approach to increasing the holding capacity of a paper supply tray it requires, of course, that the height of the housing opening be correspondingly increased to accommodate the now much deeper tray. This undesirably increases the overall height of the machine. It additionally requires that all other paper supply trays (and envelope feed trays) used with the particular machine have their depths accordingly increased to fit the enlarged housing opening.

In view of the foregoing, it is accordingly an object of the present invention to provide a paper feed tray with increased paper holding capacity, preferably a full one ream capacity, without appreciably increasing its depth.

SUMMARY OF THE INVENTION

In carrying out principles of the present invention, in accordance with a preferred embodiment thereof, an image reproduction machine, representatively a laser printer, is provided with a dual bin paper feed tray adapted to support front and rear stacks of cut paper sheets for infeed into the machine through its normal paper supply feed path. The dual bin paper feed tray is insertable, front paper stack first, into the standard height machine housing opening which normally receives a conventional paper feed tray sized to hold only a single stack of cut paper sheets-typically 250 sheets or half of the usual one ream package of printer or copier paper. Because of its unique provision of front and rear paper stack-receiving bins, each preferably sized to hold the paper contents of a conventional single bin tray, the dual bin tray of the present invention is conveniently capable of holding an entire one ream package of paper for infeed to the machine by its existing paper feed means.

The paper feed tray of the present invention basically comprises wall means for defining a paper feed tray having front and rear ends and being forwardly insertable into the housing opening, and bin-defining means which operate to define in the paper feed tray front and rear bin areas respectively configured to receive and support front and rear stacks of cut paper sheets. Holding means associated with the front bin area are operative to receive and grip the front paper sheet stack in a manner facilitating the sequential infeed of its paper sheets into the machine, via the operation of the machine's feed means, when the loaded paper feed tray is operatively inserted into the machine housing. Shifting means are associated with the rear bin area and are operable to forwardly move the rear stack of cut paper sheets from the rear bin area into the front bin area, and into gripped engagement by the holding means, when the front bin area paper supply is emptied by the machine's feed means. The rear paper stack, now operatively disposed in the front bin area, is thus readied for infeed to the machine.

The holding means include a base plate member adapted to underlie and support the front paper stack, the base plate member having a rear edge portion pivotally secured to a bottom rear portion of the front bin area. Spring means are provided to pivotally bias the base plate member in an upward direction to cause a front edge portion of the front paper stack to be gripped between the base plate and tab means which overlie a front side edge of the base plate.

The shifting means, operative in response to a sensed emptying of paper from the front bin area, include pusher means, carried by a rear portion of the paper feed tray structure for operatively driven forward and rearward movement relative thereto between front and rear limit positions, for engaging the rear paper stack and pushing it into the front bin area. The shifting means further include rotationally drivable gear train means carried by the paper feed tray structure; means, interconnected between the gear train means and the pusher means, for operatively driving the pusher means in response to driven rotation of the gear train means; and motor means for rotationally driving the gear train means.

The bin-defining means include a pair of divider members carried on the tray structure and operatively linked to the gear train means for driven movement thereby between a first position in which the divider members project inwardly from opposite sides of the tray and serve to partially separate the front and rear bin areas and form backstops for the front paper stack, and second positions in which the divider members are retracted to permit driven passage of the rear paper stack into the front bin area.

Upon a sensed emptying of the front bin area, the motor means are automatically energized to drive the paper handling components of the tray structure in a highly power efficient sequence that advantageously tends to even out the motor loading throughout the overall paper stack handling sequence. Specifically, when the motor means are initially energized in response to a sensed total depletion of the front paper stack, a linking structure interconnected between the gear train and the base plate member is driven to pivot the base plate member downwardly from its upper limit position toward its fully lowered, paper-receiving position, while at the same time also maintaining the tab means in their raised, paper-receiving position.

Just before the base plate member reaches its pivotal lower limit position, the still rotating gear train operates to retract the divider members, thereby clearing the path for the rear paper stack to be driven into the now empty front bin area of the tray. During all of this preceding component drive activity, a lost motion portion of the gear train means prevents them from driving the pusher means from their rear limit position toward their forward limit position and thus exerting a forwardly directed shifting force on the rear paper stack.

However, after the divider members have been retracted, the lost motion portion of the gear train means shifts to a positive drive position thereof that permits continued driven rotation of the gear train means to drive the pusher means to their forward limit position, thereby moving the rear paper stack into the front tray bin area and positioning front corner portions of the shifted paper stack between the elevated tab means and corresponding front corner portions of the downwardly pivoted base plate member.

When the pusher means reach their forward limit position, and the rear paper stack has been fully shifted into the front bin area, the motor means are caused to reverse. Reversal of the motor means returns the pusher means to their rear limit position; allows the spring means to upwardly pivot the base plate member, thereby causing the forwardly shifted paper stack to be operatively gripped between the base plate member and the tab means; and shifts the divider members back to their inwardly projecting first position to ready the rear bin area for the positioning therein of a new paper stack which will ultimately be shifted into the front tray bin area when it is emptied.

DETAILED DESCRIPTION

Figure 1:
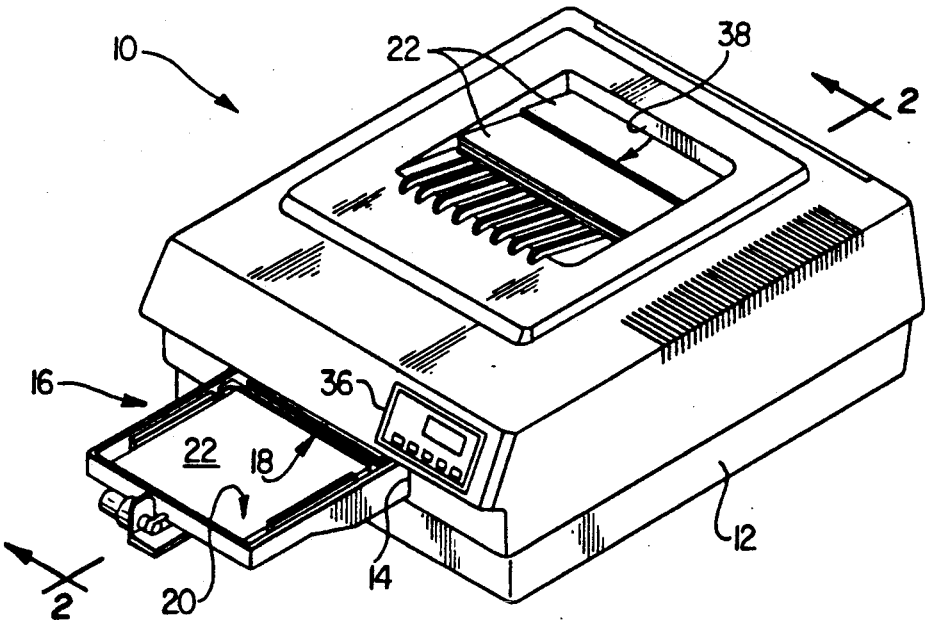
FIG. 1 is a perspective view of an image reproduction machine, representatively in the form of a laser printer, having a specially designed dual bin paper feed tray operatively inserted in an opening in the machine housing and embodying principles of the present invention.

Referring initially to FIGS. and 2, the present invention provides an improved image reproduction machine which is representatively illustrated as being a laser printer 10, although it could alternatively be another type of image reproduction machine such as a copier or non-laser type printer. Laser printer 10 includes a housing 12 having a front opening 14 therein which removably receives a specially designed dual bin paper feed tray 16 that embodies principles of the present invention and, in a manner subsequently described, is adapted to receive and support front and rear stacks 18, 20 of cut paper sheets 22 for infeed to the printer 10.

The dual bin paper feed tray 16 is conveniently sized so that each of the front and rear paper stacks 18, 20 may hold 250 sheets of cut paper, thereby permitting the tray 16 to be operatively loaded with a full one ream package of paper. The illustrated paper sheets 22 are representatively shown as being a standard $8\frac{1}{2}'' \times 11''$ size, with the long dimensions of the sheets being disposed at the front and rear sides of the paper stacks so that, in a manner subsequently described, the sheets 22 are fed sideways into the printer 10.

Figure 2:
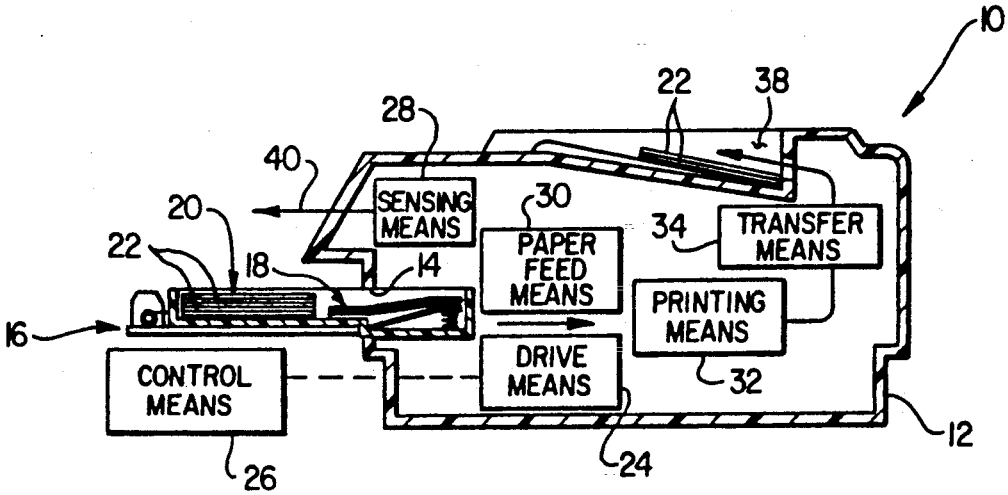
FIG. 2 is a cross-sectional view through the printer and tray taken along line 2—2 of FIG. and further illustrating, in schematic form, various controls associated with the printer and tray.

As shown in FIG. 2, the printer 10 is provided with schematically depicted drive means 24, control means 26, paper sensing means 28, paper feed means 30, printing means 32, and paper transfer means 34—all of generally conventional construction and operation. The control means 26 are conveniently positioned on a small control panel 36 (FIG. 1) disposed on the front side of the printer housing 12. During operation of the printer 10 with the loaded tray 16 forwardly inserted into the housing opening 14, the paper feed means 30 are regulated by the control means 26 to sequentially feed paper sheets 22 from the top of the front stack 18 into the interior of the housing 12. Sheets 22 exiting tray 16 from the front stack 18 are delivered, by drive means 24, to the printing means 32 which suitably imprint the sheets. The printed sheets 22 exiting the printing means 32 are delivered by the transfer means 34 to an external receiving well area 38 recessed into the top side of the printer housing 12.

During the infeed of the sheets 22 from the front paper stack 18 into the housing 12, the sensing means 28, in a conventional manner, continuously monitor the presence of paper in the front stack 18. Upon detecting that the front paper stack 18 has been entirely depleted, the sensing means 28 output an appropriate "paper empty" control signal 40. In a manner subsequently described, a unique shifting mechanism in the tray 16 is then operated in response to signal 40 to forwardly move the rear paper stack 20 to the tray area previously occupied by the now-depleted front stack 18, thereby automatically readying the rear stack 20 for infeed to the printer by the paper feed means 30 and uniquely doubling the paper storage and feed capacity of the tray 16 without requiring an increase in the height of the housing opening 14.

Figure 3A:
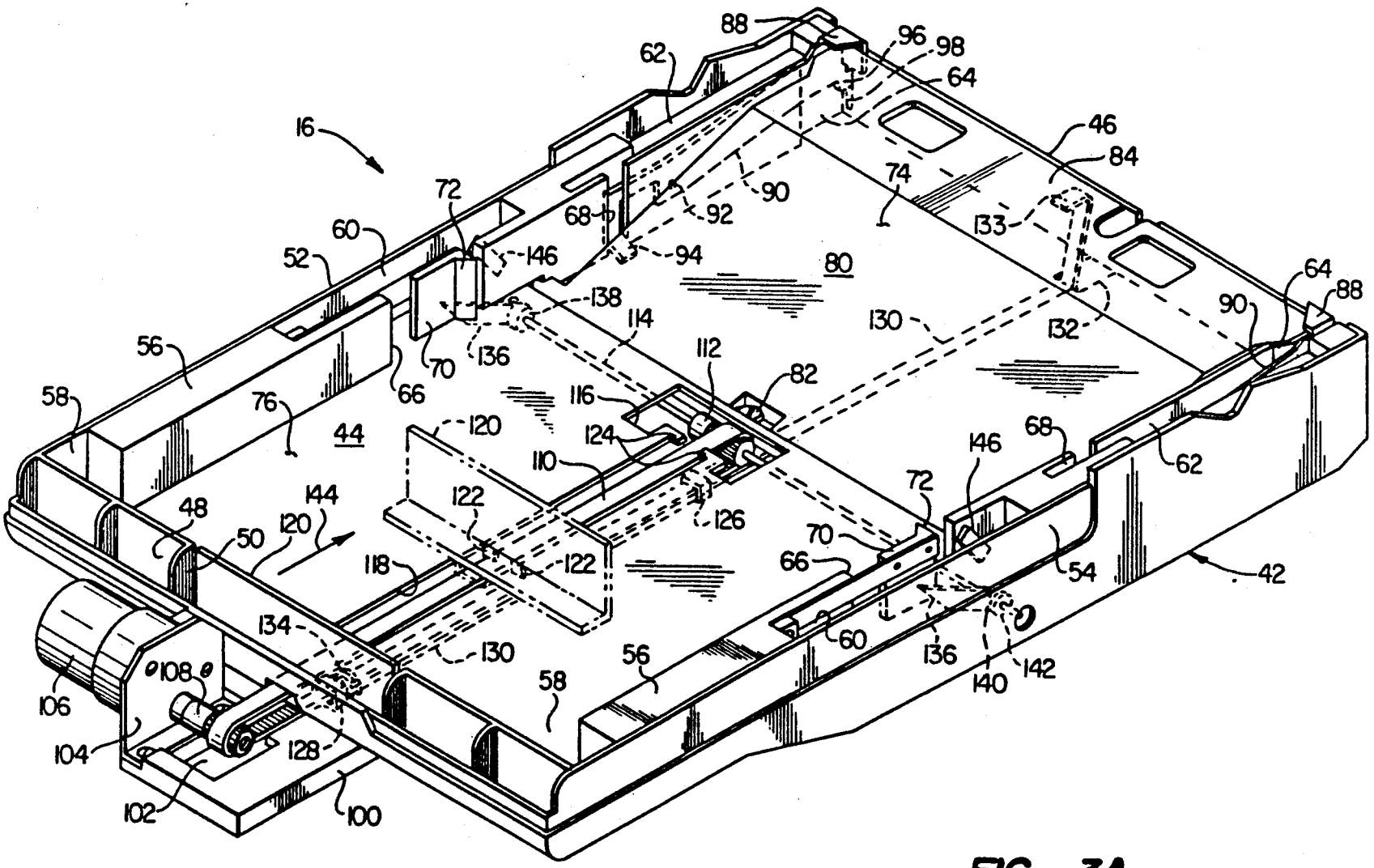
FIG. 3A is an enlarged scale perspective view of the tray illustrating in phantom a partial forward movement of a rear pusher plate portion of the tray which initiates a downward pivotal movement of a forwardly disposed support plate portion of the tray.
Figure 3B:
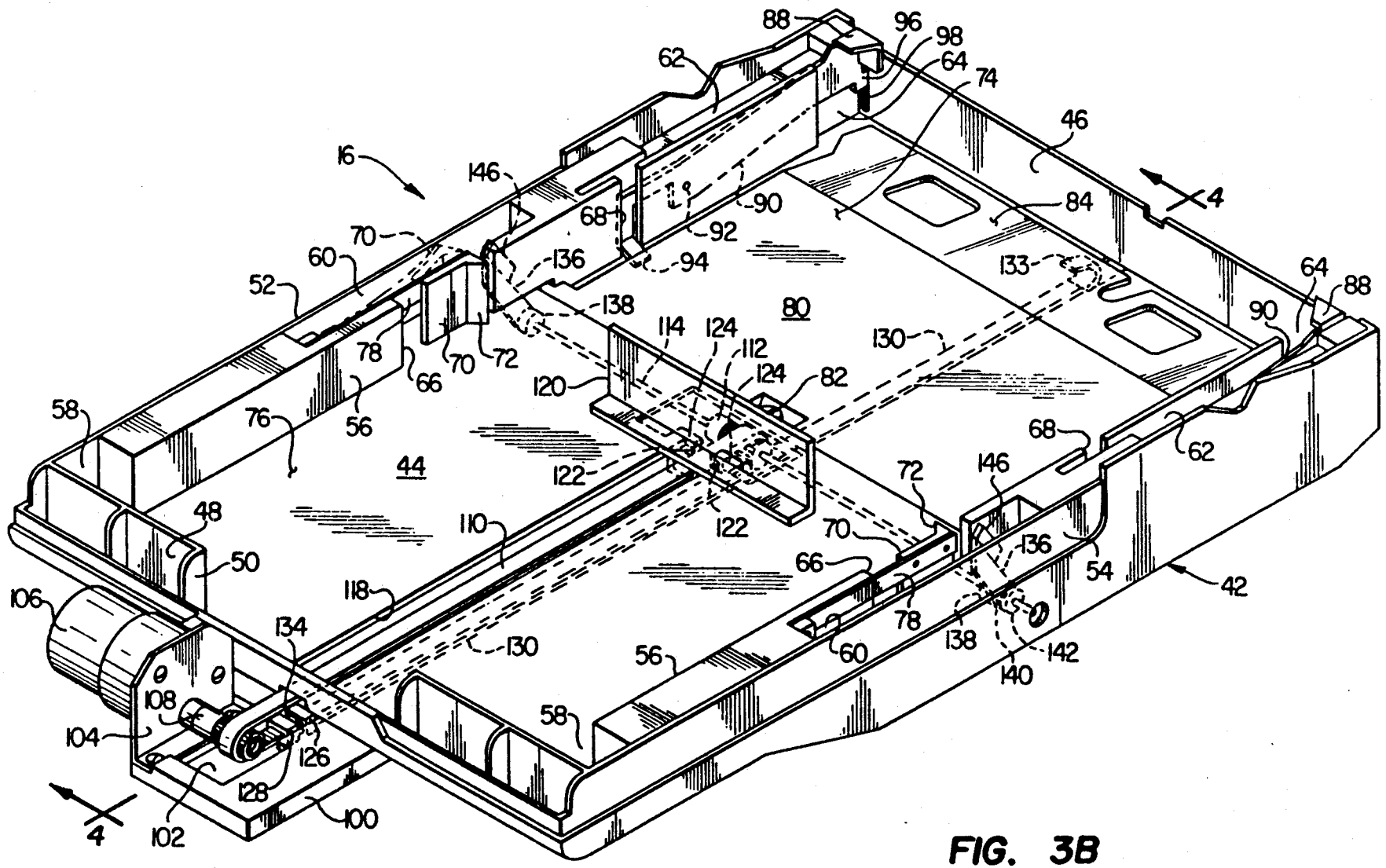
FIG. 3B is a perspective view of the tray similar to that in FIG. 3A but with the pusher plate moved to its forward limit position, and the support plate downwardly pivoted to its lower limit position.
Figure 4:
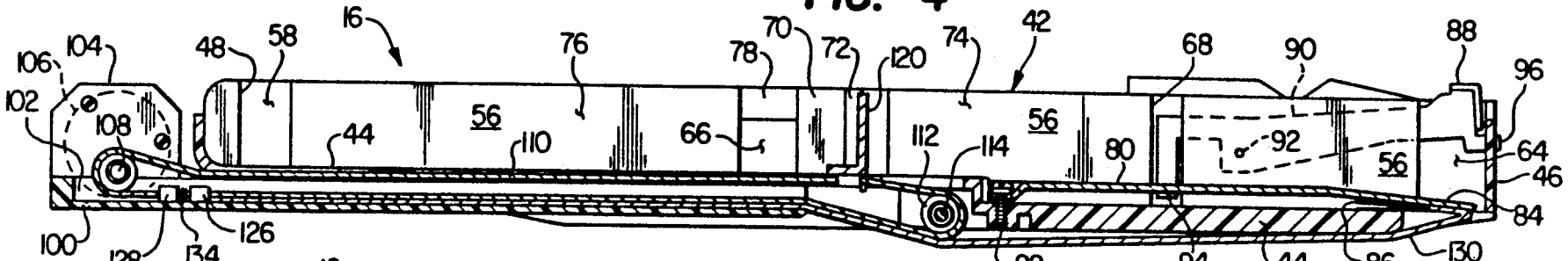
FIG. 4 is a cross-sectional view through the tray taken along line 4—4 of FIG. 3B.

Turning now to FIGS. 3A, 3B and 4, the dual bin paper tray 16 includes an elongated rectangular tray structure 42 having an open top side, a bottom wall 44, a front end wall 46, a rear end wall 48 having a central gap 50 formed therein, and a pair of exterior left and right outer side walls 52 and 54. Extending along the inner sides of the opposite tray walls 52, 54 are thickened inner side wall structures 56 having, from left to right, cut out areas 58, 60, 62 and 64. The cut out areas 60 and 62 communicate with the interior of the tray structure 42 between the inner side wall structure 56 via slots 66 and 68 formed in the inner sides of the wall structures 56.

Disposed in the slots 66 are a pair of divider members 70 having front end portions 72 that project outwardly beyond the slotted areas 66 and serve to partially separate the interior of the tray structure 42 into front and rear bin areas 74 and 76 respectively configured to closely receive and operatively support the front and rear paper stacks 18 and 20, respectively. The divider members 70 are supported on the inner side wall structure 56 by elongated thin metal spring members 78 which, for purposes later described, permit the divider members 70 to be resiliently deflected into their associated side wall cut out areas 60 as indicated by the dotted line position of the left divider member 70 in FIG. 3B.

Positioned in the front bin area 74 is a rectangular support plate 80 having a rear edge portion pivotally secured to the bottom tray wall 44 by a screw 82, and a slightly downwardly bent front side edge portion 84. The support plate 80 is pivotable about the screw 82 between an upper limit position (FIG. 3A) and a lower limit position (FIG. 4). Support plate 80 is pivotally biased, in a counterclockwise direction, toward its upper limit position by a pair of cylindrical spring members 86 which bear at their opposite ends against the lower tray wall 44 and the underside of the support member front edge portion 84 as illustrated in FIG. 4.

With the support plate 80 in its upper limit position, front corner portions of the support plate upwardly engage the inturned front end tab portions 88 of a pair of elongated paper support bars 90 which are pivoted, as at 92, within the cut out areas 62 and have rear end tab portions 94 which project outwardly through the side wall slots 68 and underlie the support plate 80.

For purposes later described, the front ends of the support bars 90 are also provided with forwardly projecting tabs 96 received in vertically elongated slots 98 formed through the front end wall 46 of the tray structure 42.

An elongated support bar member 100, having a longitudinally extending trough 102 formed in its upper side surface, is suitably affixed to the underside of the tray structure beneath the rear bin area 76, with a left end portion of the support bar 100 projecting leftwardly beyond the rear end wall 48 of the tray structure 42. A mounting bracket 104 is secured to the left end of the support bar 100 and supports a reversible electric drive motor 106 having an output shaft 108. The left end of an endless drive belt 110 is drivably looped around the motor shaft 108, while the right end of the belt 110 is drivingly looped around a radially enlarged central portion 112 of an elongated shaft 114 which is positioned beneath a rear section of the front bin area 74 and is journaled at its opposite ends in the tray side walls 52 and 54. The radially enlarged shaft portion 112 is positioned beneath a cut out area 116 formed through the bottom tray wall 44 directly behind the pivoted support plate 80. The top side of the belt 110 is recessed into an elongated trough 118 formed in the top side of the bottom tray wall 44 within the rear bin area 76, while the bottom side of the belt 110 is disposed within the elongated trough 102 extending along the length of the top side of the support bar member 100.

An upstanding pusher plate member 120 is suitably anchored to the top side of the belt 110 and has a pair of stop tabs 122 which extend down into the trough 118 and straddle the top side of the belt 110. As can be seen by comparing the solid line positions of the pusher plate 120 in FIGS. 3A and 3B, rotation of the motor shaft 108 in appropriate directions is operative to move the pusher plate 120 forwardly and rearwardly along the bottom of the tray structure 42 between a rear limit position (FIG. 3A) in which the pusher plate is disposed within the rear end wall gap 50 of the tray, and a forward limit position (FIG. 3B) in which the pusher plate is adjacent the radially enlarged portion 112 of the transverse shaft 114. In the forward limit position of the pusher plate 120, the pusher plate tabs 122 engage an inturned pair of stop tabs 124 at the right end of the trough 118.

For purposes later described, a small hollow stop block member 126 is anchored to the bottom side of the belt 110 and rides in the trough 102 on the upper side of the support bar member 100. Circumscribing the lower side of the belt 110 to the left of the stop block 126 is a small hollow stop block member 128 which also rides in the trough 102. The block 128 is anchored to the left end of an elongated flexible belt member 130 which longitudinally extends in a front-to-rear direction beneath the bottom wall 44 of the tray structure 42. As best illustrated in FIG. 3A, a right end portion of the belt member 130 extends upwardly through an opening 132 in front end of the bottom tray wall 44, and is secured, as at 134, to the underside of the front portion 84 of the support plate 80. The belt member 130 is slidably extended leftwardly through the stop block 126, and the stop block 128 permits sliding movement of the lower side of the belt 110 therethrough. Secured to the stop block 128, and projecting rightwardly therefrom, is a small spring member 134.

When the pusher plate 120 is in its solid line rear limit position shown in FIG. 3A, the stop block 126 is positioned adjacent the trough tabs 124, and the support plate 80 is pivotally biased to its upper limit position by the coil springs 86. The divider members 70 are prevented from being deflected into their associated cut out areas 60 by a pair of elongated locking members 136 which are disposed within the cut out areas 60 and engage the outer sides of the divider members 70. At their inner ends, the locking members 136 are frictionally connected to the transverse shaft 114 and abut radially enlarged portions 138 thereon, the inner ends of the locking members 136 being frictionally held against the radially enlarged shaft portions 138 by means of wavy washers 140 and snap rings 142. This frictional securement of the locking members 136 to the transverse shaft 114 permits the locking members to be rotated by the shaft, but also permits the locking members to be manually rotated relative to the shaft 114 if desired.

Still referring to FIG. 3A, a clockwise rotation of the motor shaft 108 drives the pusher plate rightwardly from its solid line, rear limit position toward its front limit position (shown in FIGS. 3B and 4) as indicated by the arrow 144 and the dotted line position of the pusher plate 120. As the pusher plate 120 is moved rightwardly, the clockwise rotation of the belt 110 moves the stop block 126 leftwardly along the belt 130 until the stop block 126 engages the spring portion 134 of the stop block 128. Further rightward driven movement of the pusher plate 120 causes the leftwardly moving block 126 to drive the stop block 128 leftwardly toward its position depicted in FIG. 3B. In turn, the leftward movement of the block 128 pulls the belt 130 in a leftward direction to downwardly pivot the support plate 80 toward its lower limit position.

As the support plate 80 downwardly approaches its lower limit position, the support plate engages the rear end tab portions 94 of the paper support bars 90 and correspondingly causes the support bars 90 to be pivoted in a counterclockwise direction to thereby lift the front tabs 88 thereof as may be seen by comparing FIG. 3A to FIG. 4. The clockwise rotation of the belt 110 which rightwardly drives the pusher plate 120 also causes the locking members 136 to be pivoted in a clockwise direction until they are disengaged from the back sides of the divider members 70. Further clockwise rotation of the locking members 136 drives them into engagement with a pair of stop members 146 disposed within the cut out areas 60 (FIG. 3B), thereby permitting the divider members 70 to be resiliently deflected into the cut out areas 60 in a manner subsequently described. Still further clockwise rotation of the belt 110 after the locking members 136 have engaged their associated stop members 146 simply causes the transverse shaft 114 to be rotated relative to the stopped blocking members 136.

When the pusher plate 120 reaches its forward limit position depicted in FIG. 3B, the support plate 80 is in its lower limit position, the front tabs 88 of the paper support bars 90 are pivoted upwardly, and the pusher plate stop tabs 122 are forced into engagement with the trough tabs 124. The engagement between the tabs 122, 124 creates an overload condition in the drive motor 106 which is appropriately sensed and used to reverse the drive direction of the motor 106 and return the pusher plate 120 from its forward limit position (FIG. 3B) to its rear limit position shown in FIG. 3A. The return of the pusher plate 120 to its rear limit position returns the locking members 136 to their divider member locking positions, and also moves the stop block 126 out of engagement with the stop block 128 to permit the support plate 80 to be returned to its upper limit position by the springs 86. The return of the support plate 80 to its upper limit position permits the paper support bars 90 to be pivoted by gravity back to their FIG. 3A positions, the tabs 96 sliding downwardly in the front end wall slots 98.

The cooperation between and among the various structural elements of the dual bin paper tray 16 just discussed is utilized to uniquely handle the front and rear paper stacks 18 and 20 in a manner which will now be

Figure 5A:
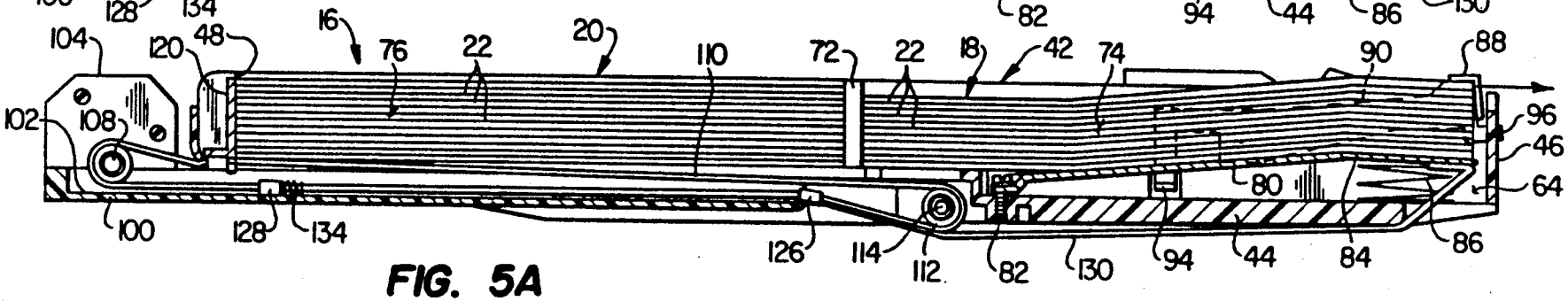
FIGS. 5A–5C are cross-sectional views through the tray sequentially illustrating the manner in which it is motor-driven to feed front and rear stacks of cut paper sheets to the printer.
Figure 5B:
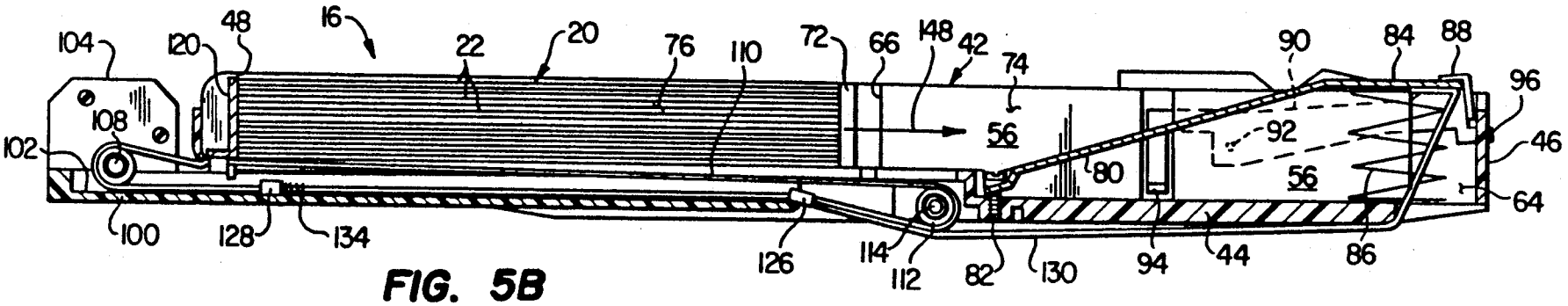
Figure 5C:
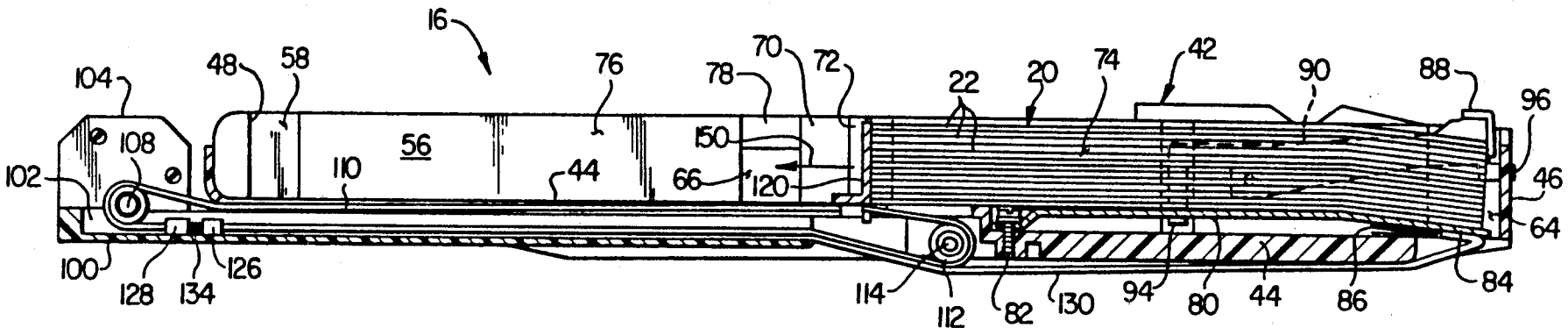

20 described in conjunction with FIGS. 5A–5C. Referring initially to FIG. 5A, with the tray 16 removed from the housing opening 14, and the pusher plate 120 moved to its rear limit position, the rear paper stack 20 is simply dropped into the rear bin area 76. The front paper stack 18 is inserted into the front bin area 74 by manually depressing the support plate 80 to its lower limit position, inserting the paper stack 18 into the front bin area, and positioning a front edge portion of the front paper stack between the front portion 84 of the support plate and the now elevated front tab portions 88 of the paper support bars 90. The inserted front paper stack 18 is then released to permit the springs 86 to pivot the depressed support plate 80 upwardly until a front edge portion of the inserted front paper stack 18 is operatively gripped between the front support plate portion 84 and the tabs 88 to facilitate the infeed of the sheets 22 in the front paper stack into the machine housing by the previously mentioned paper feed means 30 (FIG. 2).

The loaded paper tray 16 is then forwardly inserted into the housing opening 14 as shown in FIG. 2, thereby readying the printer 10 for operation. On demand, the paper feed means 30 operate to sequentially feed paper sheets 22 from the front paper stack 18, from the top of the stack 18, into the printer 10. When the front bin area 74 has been emptied, as depicted in FIG. 5B, the paper sensing means 28 detect the absence of paper in the front bin area and responsively generate the previously mentioned "paper empty" signal 40 (FIG. 2) which is utilized to energize the drive motor 106 to initiate a clockwise rotation of the drive belt 110. The clockwise rotation of the drive belt 110, as previously described, initiates a forward movement of the pusher plate 120 as indicated by the arrow 148 in FIG. 5B.

Just after the pusher plate 120 begins its rightward movement, the locking members 136 are pivoted to their unlocked position which permits the forward movement of the opposite front corners of the rear paper stack 20 to outwardly deflect the divider members 70 into their associated cut out areas 60 (FIG. 3B), thereby permitting the rear paper stack 20 to be moved forwardly beyond the deflected divider members 70 and into the front bin area 74. Further rightward movement of the pusher plate 120, as also previously described, pivots the support plate 80 downwardly toward its lower limit position and continues to move the rear paper stack 20 into the front bin area 74. As the front end of the paper stack 20 approaches the front end of the tray structure 42, the pusher plate approaches its forward limit position (FIG. 5C) and the tabs 88 are automatically lifted to facilitate the entry of the front end of the paper stack 20 between the support plate portion 84 and the tabs 88.

When the pusher plate 120 reaches its forward limit position, as illustrated in FIG. 5C the rear paper stack 20 has been fully inserted into the front bin area 74, and the divider members 70 are spring-returned to their non-deflected positions in which front portions of the divider members 70 act as back stops for the rear paper stack 20 now disposed in the front bin area 74. As previously described, when the pusher plate 120 reaches it forward limit position, the drive motor 106 is automatically caused to reverse, thereby returning the pusher plate 120 to its rear limit position as indicated by the arrow 150. Such movement of the pusher plate 120 toward its rear limit position permits the springs 86 to pivot the support plate 80 upwardly toward its upper limit position to operatively grip front corner portions of the paper stack 20 between the front support plate portion 84 and the tabs 88, thereby readying the now shifted rear paper stack 20 to be infed to the printer 10.

In this simple manner, an entire one ream package of cut paper sheets may be loaded into the tray 16, thereby doubling its paper storage and feed capacity without increasing the height of the housing opening 14. The components and mechanisms used to effect this unique forward shifting of the rear paper stack into the emptied front bin area are relatively simple and inexpensive, and are of a reliable and rugged construction. The tray 16 is, for the most part, able to utilize the standard operating and control systems and components normally provided in the printer 10, or other image reproduction machines such as copiers or non-laser printers.

Figure 7A:
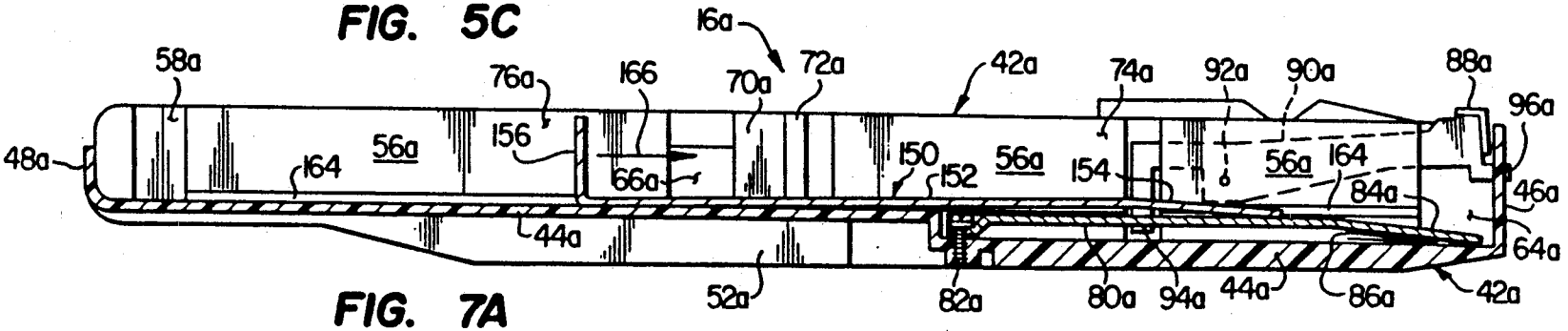
FIG. 7A is a cross-sectional view through the manually operable tray, taken along line 7A—7A of FIG. 6, with a rearwardly disposed auxiliary tray portion thereof being moved partially toward a forward limit position thereof and initiating a downward pivotal movement of the forwardly disposed support plate.
Figure 7B:
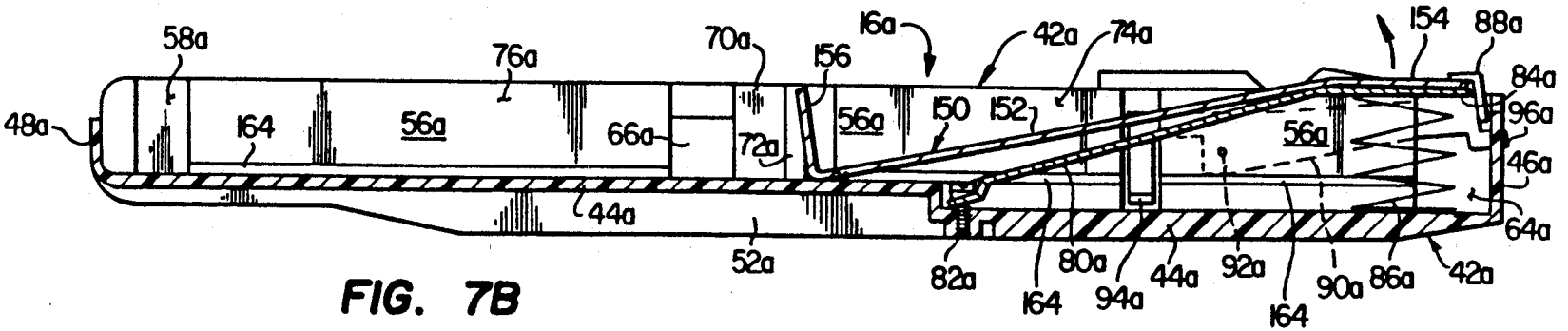
FIG. 7B is a cross-sectional view similar to that in FIG. 7A, but with the auxiliary tray moved to its forward limit position and the support plate and auxiliary tray upwardly pivoted to upper limit positions thereof.
Figure 6:
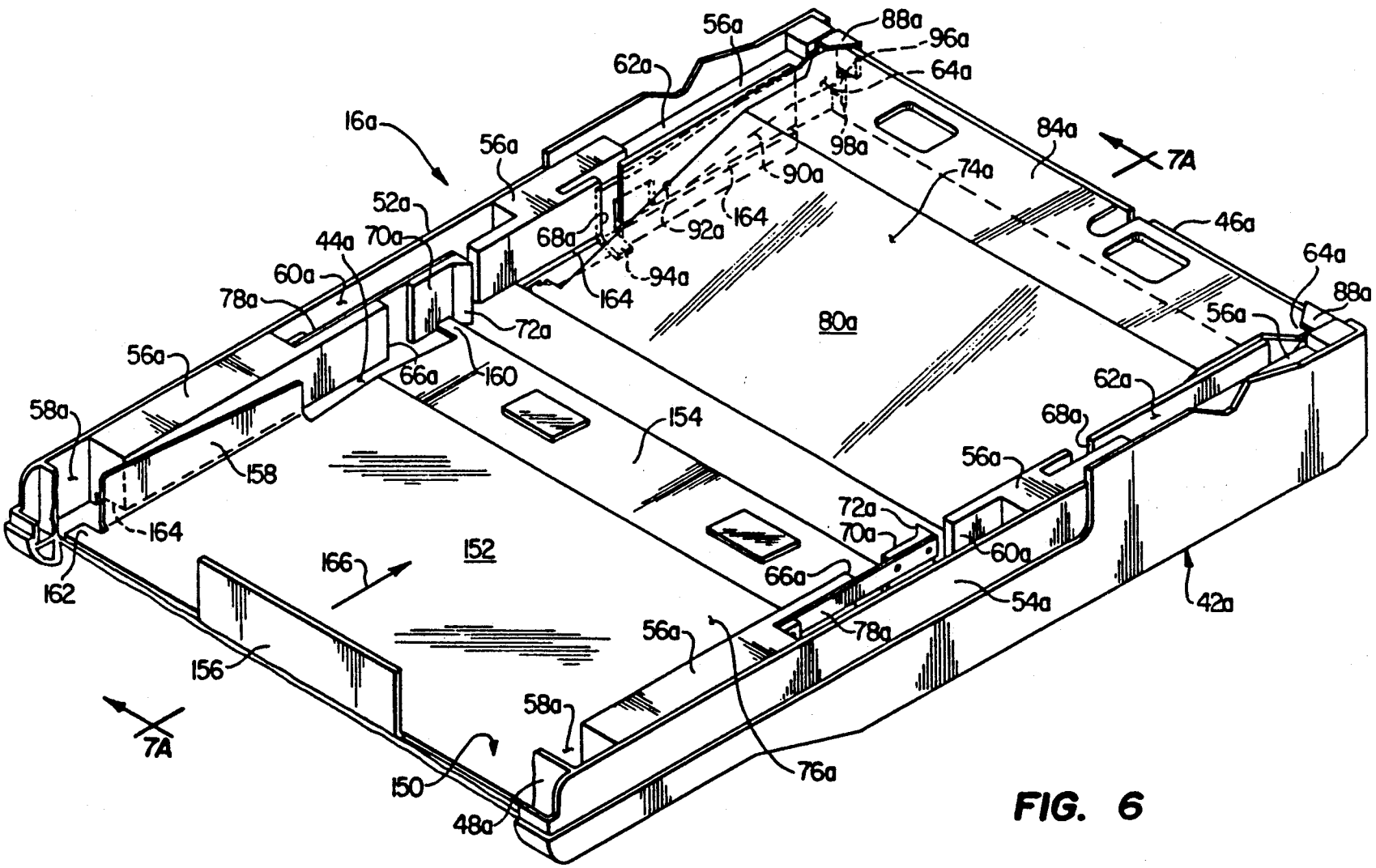
FIG. 6 is a partially cut away perspective view of an alternate, manually operable embodiment of the dual bin paper tray.

An alternate embodiment 16*a* of the dual bin paper tray 16 is depicted in FIGS. 6, 7A and 7B and is similar to tray 16 except that the previously described shifting of the rear paper stack into the emptied front bin area is effected manually instead of automatically. For ease of comparison, parts in the tray 16*a* similar to those in tray 16 have been given identical reference numerals having the subscripts "a".

In the manually operable tray 16*a*, the previously described support bar 100, drive motor 106, belts 110 and 130, shaft 114, and pusher plate 120 are deleted. In place of these motor-driven shifting means, an auxiliary paper tray 150 is utilized to operatively support the rear paper stack and manually shift it into the emptied front bin area.

The auxiliary tray 150 has a generally rectangular shape, and is configured to be closely received within the rear bin area 76*a* as depicted in FIG. 6. The tray 150 has a bottom wall 152 with a slightly downwardly bent front side portion 154, an upwardly bent rear end support tab 156, a pair of opposed, upwardly bent rear side support tabs 158, a pair of laterally outwardly projecting front corner guide tabs 160, and a pair of laterally outwardly projecting rear corner guide tabs 162. For purposes later described, grooves 164 are formed laterally inwardly through the undersides of the opposed pair of the thickened inner side wall structures 56*a*.

With the auxiliary tray 150 in its rear limit position within the rear bin area 76*a* as shown in FIG. 6, the front corner guide tabs 160 are rearwardly adjacent the front end portions 72*a* of the divider members 70*a*, and the rear corner guide tabs 162 project into the rear cut out areas 58*a*. The rear paper stack is simply dropped into the auxiliary tray 150 so that the rear side of the paper stack is positioned against the rear end tab 156, and the front side of the stack is just to the rear of the divider member front portions 72*a*. The front paper stack is loaded into the front bin area 74*a*, as previously described, simply by depressing the support plate 80*a*, positioning the rear side of the front paper stack against the front side of the front divider member portions 72*a*, inserting the front side of the front paper stack between the support plate front portion 84*a* and the elevated support tabs 88*a*, and then releasing the paper stack so that front corner portions thereof are operatively gripped between the support plate portion 84*a* and the overlying tabs 88*a*. The loaded dual bin paper tray 16*a* is then forwardly inserted into the housing opening 14 of the printer 10.

Referring now to FIGS. 7A and 7B (in which the loaded front and rear paper stacks have been omitted for illustrative clarity), after the front paper stack has been emptied from the front bin area 74*a* by the previously mentioned paper feed means 30 (FIG. 2), the paper sensing means 28 may be utilized to transmit a visual "paper empty" signal which appears on the control panel 36 (FIG. 1). When this situation occurs, the printer operator simply pushes the auxiliary paper tray rear end tab 156 forwardly (as indicated by the arrows 166 in FIGS. 6 and 7A) to move the auxiliary paper tray 150 and its supported rear paper stack forwardly along the interior of the tray structure 42*a*. Locking means (not shown) similar to the previously described locking members 136 may be pivotally secured to the side wall portions 56, and manually operated to selectively lock and unlock the divider members 70*a*.

As the auxiliary tray 150 is pushed forwardly, the front corner tabs 160 outwardly deflect the divider members 70*a* to permit the initial entry of the rear paper stack into the emptied front bin area 74*a*, and the front and rear corner tabs 160, 162 enter the side wall structure grooves 164, thereby restraining the auxiliary tray 150 against upward movement relative to the tray structure 42*a*. Further forward movement of the auxiliary tray 150 causes its front portion 154 to ride up over the support plate 80*a* and force it downwardly to its lower limit position, thereby raising the tabs 88*a*, as the rear paper stack carried by the auxiliary tray 150 enters the front bin area. As illustrated in FIG. 7B, when the auxiliary tray 150 is pushed fully into the front bin area 74*a*, the front corner tabs 160 (FIG. 6) rightwardly exit the slots 164 as the rear corner tabs 162 enter the slot portions just to the right of the side wall slots 66*a* (FIG. 6).

The exiting of the front corner tabs 160 from the right ends of the side wall slots 164 permits the springs 86*a* to upwardly pivot the support plate 80*a*, and the auxiliary tray 150 which overlies the support plate, toward their upper limit positions depicted in FIG. 7B, the rear end of the auxiliary tray 150 being restrained within the side wall slots 164 to permit this upward pivoting of the auxiliary tray. Upward pivoting of the auxiliary tray 150 causes front corner portions of the forwardly shifted rear paper stack to be operatively gripped between the front portion 154 of the auxiliary tray 150 and the overlying tabs $88_a$. This simple forward manual shifting of the auxiliary tray 150 operatively positions the rear paper stack within the front bin area 74*a* so that the sheets 22 in the repositioned rear paper stack may be infed to the printer 10 until the rear paper stack is depleted, at which point the front auxiliary tray portion 154 engages the tabs 88*a* (as illustrated in FIG. 7B) and the sensing means 28 create a visual signal on the control panel 36 indicating that the second paper stack has now been used up.

An alternate motor-driven embodiment 16*a* of the dual bin paper tray 16 is depicted in FIGS. 8–10C and is generally similar in operation to tray 16 except for the drive system utilized, the sequence in which the paper handling components are operated, and other structural differences subsequently described herein. For ease of comparison, parts in the tray 16*b* similar to those in tray 16 have been given identical reference numerals having the subscripts "b".

Figure 8:
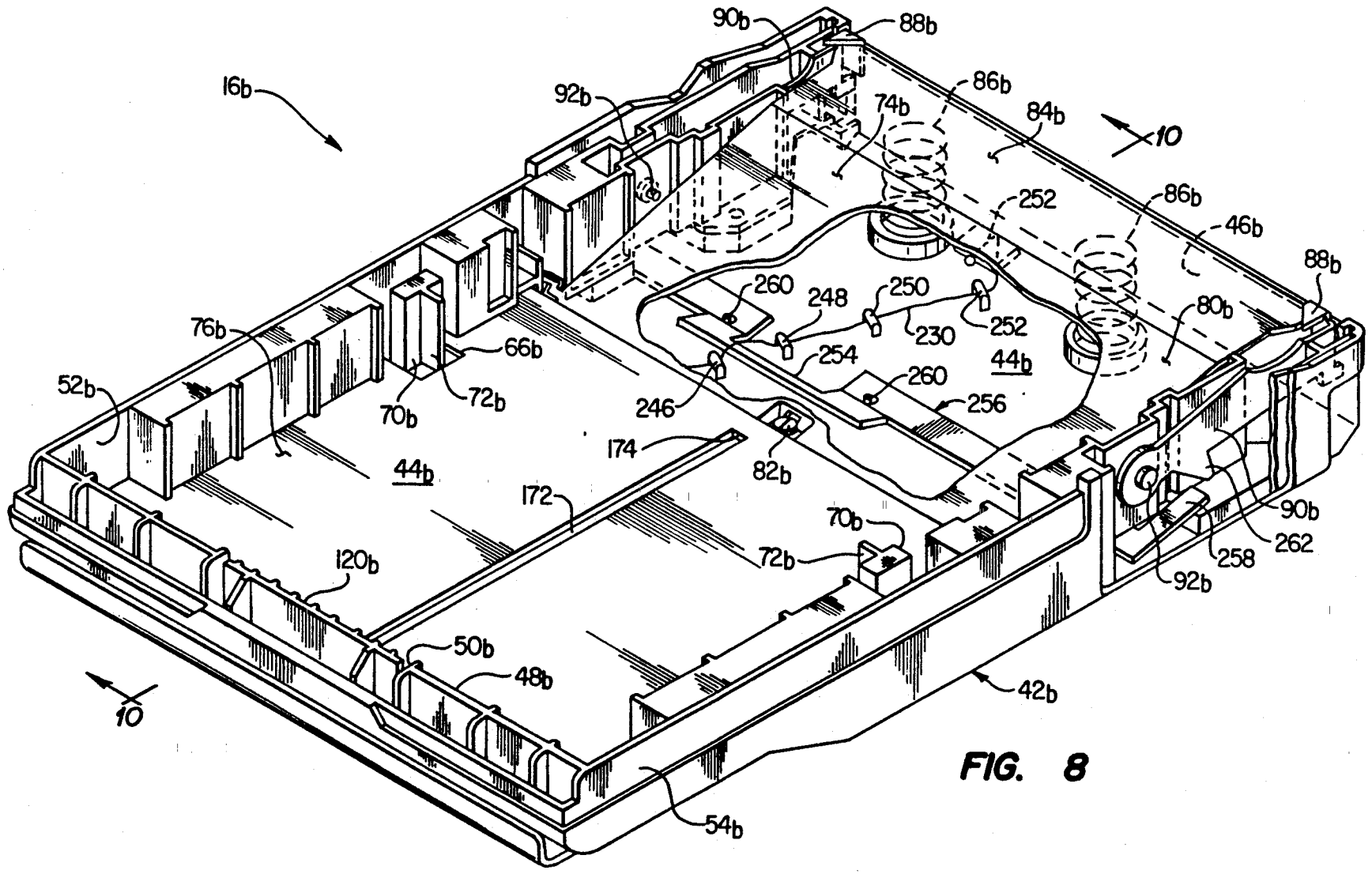
FIG. 8 is a partially cut away perspective view of an alternative embodiment of the FIG. 3A paper feed tray structure.

Turning first to FIG. 8, the tray 16b includes an elongated rectangular tray structure 42b having an open top side, a bottom wall 44b, a front end wall 46b, a rear end wall 48b having a central gap 50b formed therein, and a pair of exterior left and right outer side walls 52b and 54b. Projecting upwardly through slots 66b in bottom wall 44b are a pair of divider members 70b which, in a manner subsequently described, are movable between a first position (FIG. 8) in which front portions 72b of the members divide the interior of tray structure 42b into front and rear paper bin areas 74b and 76b, and a retracted position (see FIG. 9b) in which the dividers permit a paper stack to be pushed forwardly from the rear bin area 76b into the emptied front bin area 74b as later described.

Positioned in the front bin area 74b is a rectangular support plate 80b similar to the previously described support plate 80. A rear edge portion of plate 80b is pivotally secured to the bottom tray wall 44b by a screw 82b. Like the plate 80, the plate 80b is pivotable between an upper limit position (FIG. 10) and a lower limit position (FIG. 10B), and is biased toward its upper limit position by a pair of spring members that upwardly bear against the front end edge portion 84b of the plate.

With the support plate 80b in its upper limit position, front corner portions of the plate upwardly engage the inturned front end tab portions 88b of a pair of elongated paper support bars 90b which are pivoted at their rear ends, as at 92b, within tray side wall cut out areas 62b. An upstanding pusher plate member 120b, in its rear limit position shown in FIG. 8, is positioned within the rear end wall gap 50b and has a narrowed bottom portion 170 (see FIG. 9) extending downwardly through an elongated slot 172 formed through the bottom tray wall 44b and having a front end 174.

As will be seen, the dual bin paper tray 16b operates in generally the same manner as the previously described tray 16 in that the tray 16b functions to drive a paper stack from the rear bin area 76b into the front bin area 74b upon a sensed emptying of the front bin area. However, as will now be described, the sequence in which the paper handling components of tray 16b are driven is modified to provide for a desirable evening out of the drive motor loads throughout the overall paper shifting cycle.

Figure 9A:
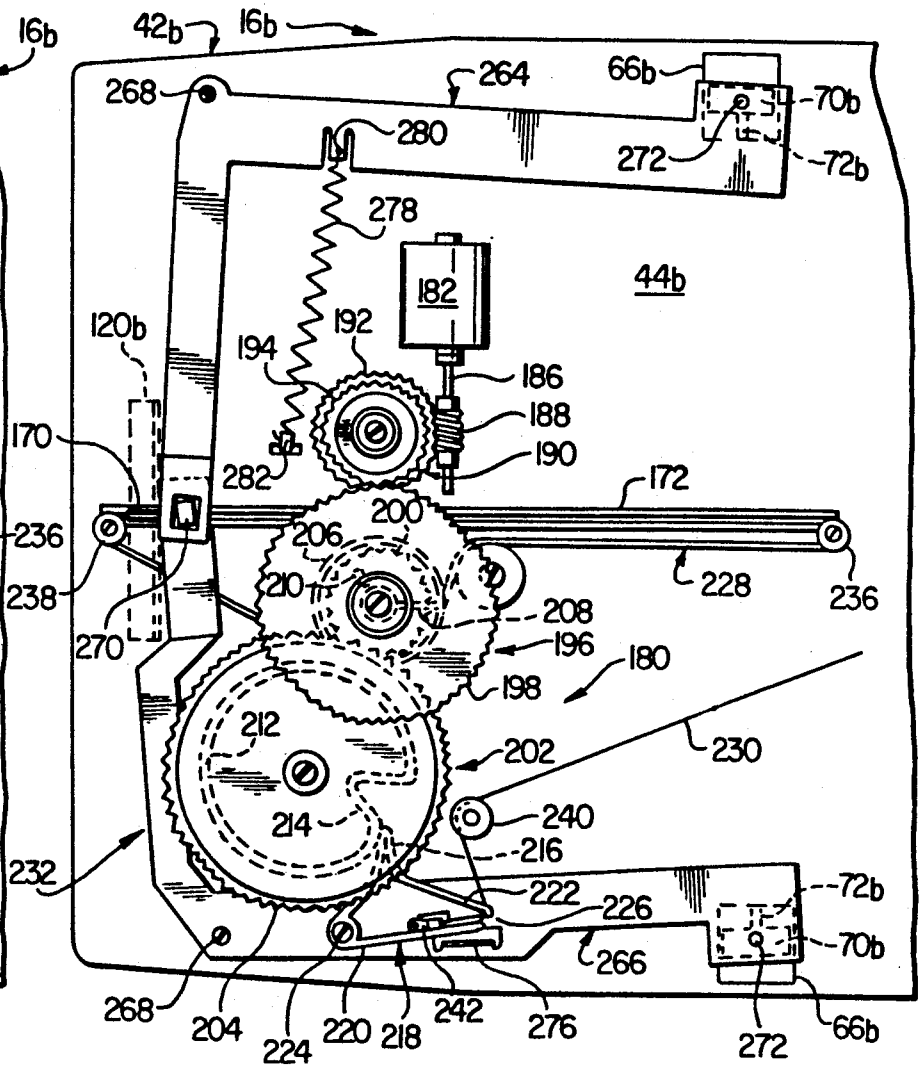
FIGS. 9–9C are simplified, partially cut away fragmentary bottom plan views of the component drive system of the FIG. 8 tray and sequentially illustrate the operation of the drive system.
Figure 9:
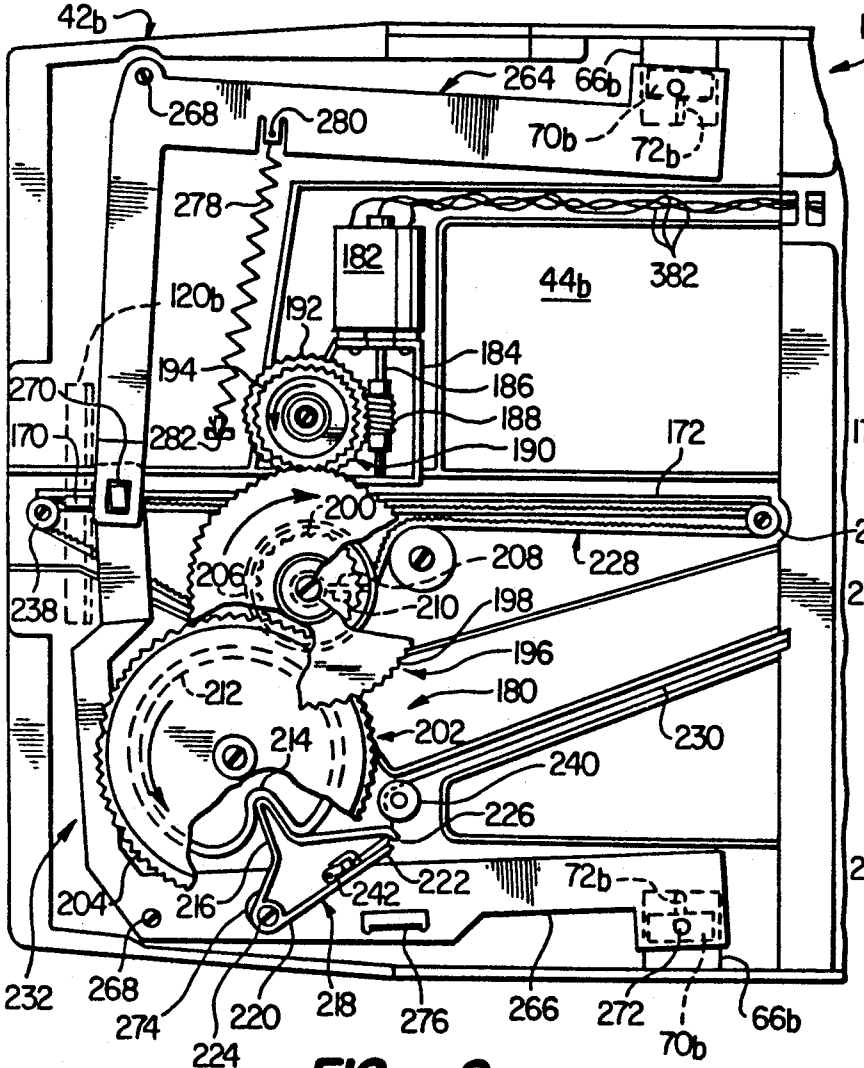
Figure 9C:
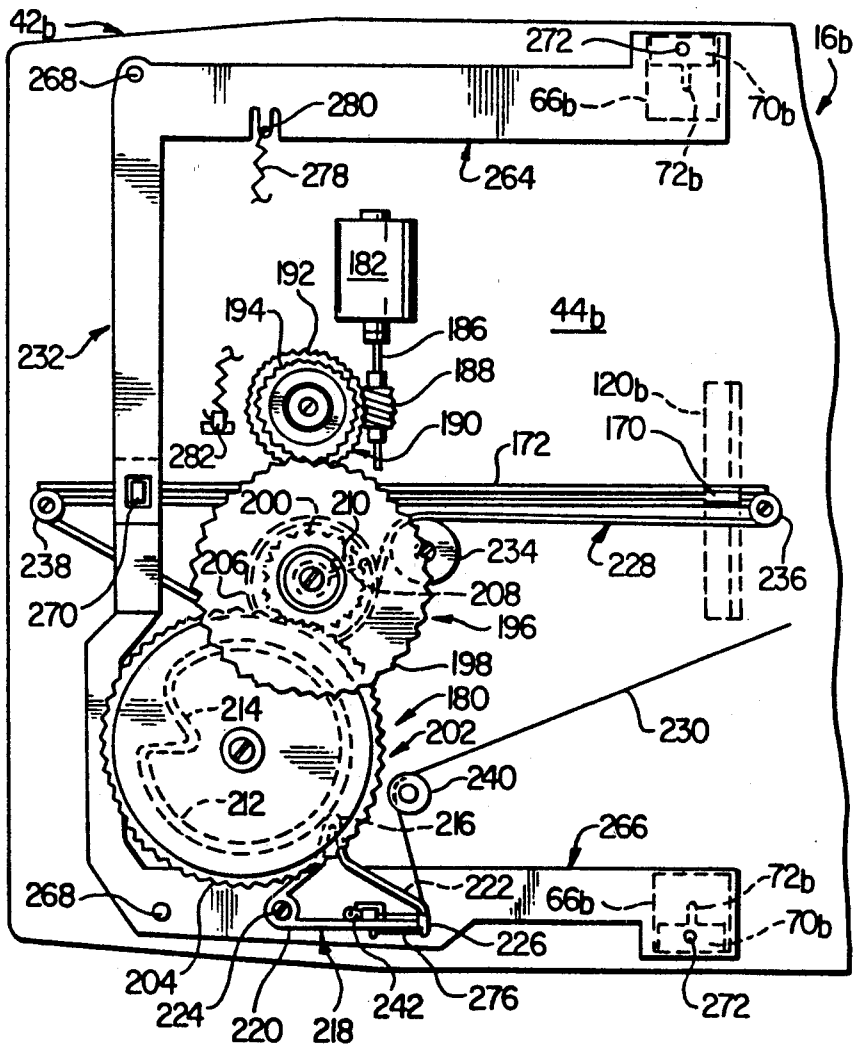

Referring now to FIG. 9, which depicts a rear underside portion of the tray 16b, the paper handling components are operated by a specially designed drive system 180 carried beneath the rear paper bin area. Drive system 180 includes a reversible electric motor 182 supported on a cradle structure 184. Cradle structure 184, along with other underside portions of the tray, has been omitted from FIGS. 9A-9C for purposes of improved illustrative clarity. Motor 182 has an output shaft 186 that is coaxially anchored to a worm gear 188.

Worm gear 188 is used to rotationally drive a gear train comprising a reduction gear 190 having a toothed portion 192, and a toothed portion 194 positioned above portion 192; a larger diameter timing drive gear 196 having an upper toothed portion 198 meshed with toothed portion 194 of gear 190, and a reduced diameter lower toothed portion 200; and a still larger diameter cam gear 202 having a toothed portion 204 meshed with toothed portion 200 of gear 196. As illustrated, the meshed gears 190, 196 and 202 are rotatable secured to the underside of the bottom tray wall 44b.

The timing drive gear 196 is coaxially positioned above a hollow cylindrical drive pulley 206 also rotatably secured to the bottom tray wall 44b. Pulley 206 has fixedly secured within its interior a radially extending drive pin 208. Projecting downwardly from the toothed portion 200 of gear 196, along the lower side of pin 208 as viewed in FIG. 9, is a drive dog 210. Pin 208 and dog 210 form a lost motion rotational drive connection between the gear 196 and the pulley 206 for purposes later described. Initially, however, it should be noted that a a clockwise driven rotation of gear 196 does not correspondingly rotate the pulley 206 until the dog 210 is rotated nearly 360 degrees and into driving engagement with the top side of the pin 208 as viewed in FIG. 9.

Projecting downwardly from the toothed portion 204 of gear 202 is a cylindrical drive section 212 having a generally radially indented cam drive slot portion 214. As viewed in FIG. 9, slot 214 receives a leg portion 216 of a hollow, generally T-shaped cam follower member 218 also having leg portions 220 and 222. The outer end of leg portion 220 is pivotally secured, by a suitable pivot member 224, to tray wall 44b. For purposes later described, the outer end of leg portion 222 has an opening 226 formed therethrough.

The drive system 180 also includes a drive belt 228, a cable 230, and a generally U-shaped divider member drive linkage structure 232. As illustrated in FIG. 9, the drive belt 228 is looped around the drive pulley 206, a central idler pulley 234, and a pair of outer idler pulleys 236,238 respectively positioned adjacent the front and rear ends of the bottom wall slot 172. Belt 228 is rotationally driven in response to rotation of drive pulley 206 and, as viewed in FIG. 9, a top left end portion of the belt is suitably anchored to the narrowed bottom portion of the pusher plate member 120b. It can thus be seen that a driven clockwise rotation of belt 228 will drive the pusher member forwardly away from its rear limit position shown in FIG. 9.

Figures 10, 10A, 10B, 10C:
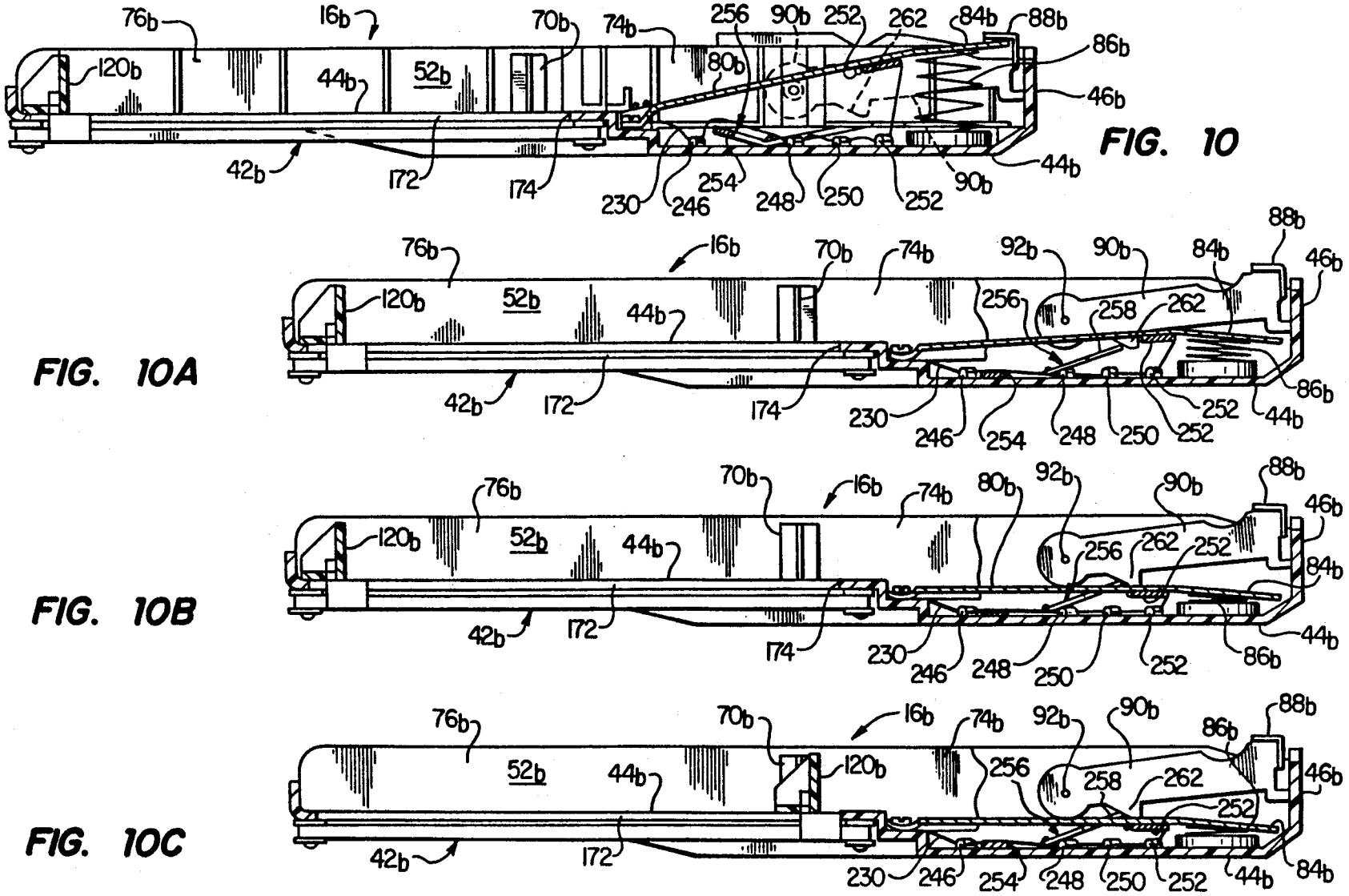
FIGS. 10–10C are simplified cross-sectional views through the FIG. 8 tray, taken along line 10—10 of FIG. 8 and respectively corresponding to FIGS. 9—9C, sequentially illustrating the operation of various paper handling components of the tray.

A left end portion of the cable 230 is passed around a pulley 240, extended through the cam leg opening 226, and suitably anchored ,as at 242, within the interior of the cam follower 218. Referring additionally now to FIGS. 8 and 10, from the pulley 240 the cable 230 is rightwardly extended beneath a spaced series of guide pin members 246,248,250 and 252 supported on the bottom wall 44b, in a slightly elevated relationship therewith, beneath the support plate 80b. The right end of the cable 230 is anchored, as at 252, to the underside of the support plate 80b somewhat inwardly of its front end edge.

Between the pins 246 and 248, the cable 230 passes over the upwardly and rearwardly bent central portion 254 of an elongated lift plate 256 that extends transversely to the tray 16b and has forwardly projecting tabs 258 on its opposite ends. Plate 256 is pivoted to the bottom tray wall 44b, at points 260 (FIG. 8), in a manner such that when the plate 256 is pivoted in a counterclockwise direction from its FIG. 8 position the outer ends of its tab portions 258 are pivoted upwardly into supporting engagement with transverse tab portions 262 of the paper support bars 90b. This, in turn, holds the front end tab portions 88b of the support bars 90b in their illustrated elevated position when the support plate 80b is downwardly pivoted as later described.

Referring again to FIG. 9, the generally U-shaped divider member drive linkage 232 straddles the motor and gear train portions of the drive system 180 and comprises a pair of generally L-shaped plates 264 and 266. The central corner portions of the plates 264,266 are pivoted at points 268 to the bottom tray wall 44b, and the left or inner end portions of the plates 264,266 are interconnected by a suitable lost motion pivot joint structure generally denoted by the reference numeral 270. The right or outer ends of the plates 264,266 are anchored at points 272 to the undersides of the divider members **70*b***.

As illustrated in FIG. 9, the cam follower pivot member 224 extends downwardly through a larger diameter circular opening 274 in plate 266, and the plate 266 is provided with an upstanding flange 276. An elongated tension spring 278 is anchored at one end 280 thereof to a central portion of the plate 264, and at the other end 282 thereof to the underside of the bottom tray wall **44*b*. As may be seen by comparing FIG. 9 to FIG. 9B, the linkage plates 264,266 are pivotable between a first position (FIG. 9) in which they hold the divider members 70*b* in their laterally innermost position, and a second position (FIG. 9B) in which they shift the divider members outwardly to their retracted positions. Spring 278 resiliently biases the plates 264,266 toward their first position shown in FIG. 9**.

To illustrate the operating sequence of the dual bin paper tray **16*b* it will be assumed that the paper handling and drive components of the tray are in their starting orientations shown in FIGS. 8, 9 and 10, and that the paper stack in the front bin area 74*b* has just been depleted and needs to be refilled by moving the previously loaded paper stack (not shown) from the rear bin area 76*b* into the now empty front bin area. Upon a sensed emptying of the front tray bin, the drive motor 182 is energized, via electrical leads 282, to rotate gear 190 in the indicated counterclockwise direction thus rotating gears 196,202** in clockwise and counterclockwise directions, respectively.

With the components of drive system 180 in their FIG. 9 starting positions, the cable 230 is in a generally slackened condition so that the support plate **80*b* is in its upper limit position and the plate tabs 258 (FIG. 8) are positioned below the tabs 262. Counterclockwise rotation of gear 202 rotates the cam follower 218 in a clockwise direction, thereby tensioning the cable 230 and downwardly pivoting the support plate 80*b* as may be seen by comparing FIGS. 9 and 10 to FIGS. 9A and 10A. Tensioning of the cable 230 also pivots the elongated plate 256 in a counterclockwise direction, thereby pivoting its end tabs 258 upwardly into contact with the tabs 262 of paper support bars 90*b*. In turn, this pivots bars 90*b* in a counterclockwise direction. Accordingly, as the support plate 90*b* is downwardly pivoted the tabs 88*b*** are supported in their upper limit position to facilitate subsequent entry of the rear paper stack into the emptied front bin area.

In contrast to the operation of the previously described tray 16, during the downward pivoting of the support plate **80*b*, the pusher plate member 120*b* remains in its rear limit position. This is due to the lost motion connection between the drive train gear 196 and the drive pulley 206. Specifically, as can be seen by comparing FIGS. 9 and 9A, the initial rotation of gear 196 does not correspondingly rotate either the pulley 206 or the belt 228. In FIG. 9A the drive dog 210 has been rotated in a clockwise direction away from the drive pin 208**, but has not yet been rotated into driving contact with the top side of such pin.

Figure 9B:
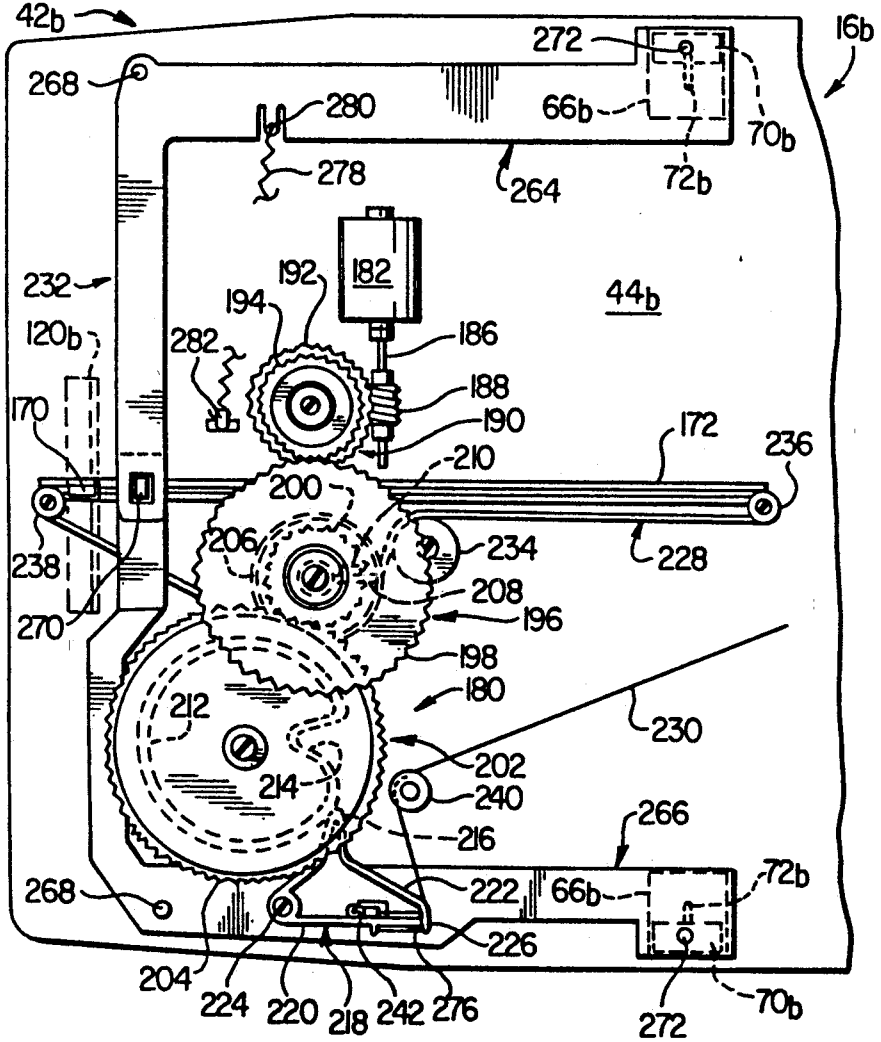

Further driven clockwise rotation of the cam follower 218 beyond its FIG. 9A position brings the cam follower leg 222 into contact with the upstanding plate flange 276 to thereby outwardly pivot the L-shaped plates 264 and 266, as may be seen by comparing FIG. 9A to FIG. 9B, and driving the divider members **70*b* to their retracted positions. As the divider members 70*b* reach their retracted positions, the support plate 80*b* reaches its lower limit position (see FIG. 10B), and the cam follower leg 216 is withdrawn from the cam slot 214 so that leg 216 rides along the nonindented outer side surface of the cylindrical drive section 212 during continued counterclockwise rotation of the gear 202**.

This prevents the cam follower 218 from rotating in a counterclockwise direction, thereby holding the support plate **80*b* in its downwardly pivoted lower limit position, and also prevents further tensioning of the cable 30. As the cam follower leg 216 exits the cam slot 214 in this manner, the drive dog 210 is brought into driving contact with the top side of the drive pulley pin 208 (see FIG. 9B) while the linkage plates 264,266 are still held in their outwardly pivoted positions against the resilient biasing force of the spring 278**.

Further clockwise driven rotation of gear 196 then correspondingly drives the underlying pulley 206 to thereby rotate the belt 228 in a clockwise direction. Such driven rotation of belt 228 moves the pusher plate **120*b* forwardly through the rear bin area 76*b* as may be seen by comparing FIGS. 9B and 10B to FIGS. 9C and 10C. Such forward movement of the pusher plate 120*b*, of course, operates to shift the rear paper stack (not illustrated) from the rear bin area to the front bin area as previously described in conjunction with the dual bin paper tray 16. When the pusher plate 120*b* reaches its front limit position shown in FIGS. 9C and 10C, the pusher plate bottoms out against the front end 174 of slot 172**.

When this occurs, the increased drive motor load is sensed and motor 182 is appropriately caused to reverse, thereby reversing the rotational directions of the drive train gears 190, 196 and 202. During an initial period of this gear train directional reversal the paper handling components remain in the positions thereof achieved when the pusher plate **120*b*** reached its forward limit position.

However, when the drive dog 210 is rotated back into driving engagement with the bottom side of pin 208, the pusher plate **120*b* is driven rearwardly toward its rear limit position. Generally simultaneously with this, as the cam follower let portion 216 follows the profile of its associated cam face, the divider members 70*b* are returned to their first positions (FIG. 8), the support plate 80*b* is permitted to be pivotally spring-returned toward its FIG. 8 position, and the paper support bars 90*b* are disengaged by the tabs 258 and also return to their FIG. 8** positions as the pusher plate nears its starting rear limit position described above.

The operating sequence just described for the tray **16*b* desirably evens out the operating loads on the drive motor 182 (compared to the operating loads on the drive motor of tray 16) due to the fact that motor 182 operates to downwardly pivot the support plate 80*b*, and outwardly retract the divider members 70*b* before forwardly moving the pusher plate member 120*b* and shifting the rear paper stack into the emptied front tray bin area. Additionally, the drive system of tray 16*b* has a more compact configuration than that of tray 16 since the motor 182 is carried beneath tray 16*b* and does not project outwardly beyond its rear end as is the case with the drive motor 106 of tray 16**.

The foregoing detailed description is to be clearly understood as being given by way of illustration and example only, the spirit and scope of the present invention being limited solely by the appended claims.

What is claimed is:

1. Paper supply apparatus for supplying paper to an image reproduction machine having a housing, an opening formed in said housing, feed means operative to feed paper into said housing from a paper supply stack disposed adjacent said opening, and printing means for imprinting paper fed into said housing, said paper supply apparatus comprising:

a paper feed tray structure having front and rear ends and being forwardly insertable into said housing opening;

bin-defining means for defining in said paper feed tray structure front and rear bin areas respectively configured to receive and support front and rear stacks of cut paper sheets;

holding means, associated with said front bin area, for receiving the front paper stack and gripping it in a manner facilitating the sequential infeed of its paper sheets into said machine by said feed means when said paper feed tray is inserted into said housing opening; and shifting means operable to shift the rear stack of cut paper sheets into said front bin area, and into gripped engagement by said holding means, when said front bin area is empty, said shifting means including:

pusher means, carried by a rear portion of said paper feed tray structure for operatively driven forward and rearward movement relative thereto between front and rear limit positions, for engaging the rear paper stack and pushing it into said front bin area, rotationally drivable gear train means carried by said paper feed tray structure, means, interconnected between said gear train means and said pusher means, for operatively driving said pusher means in response to driven rotation of said gear train means, and motor means for rotationally driving said gear train means.

2. The paper supply apparatus of claim 1 wherein:

said gear train means and said motor means are disposed beneath said rear bin area.

3. The paper supply apparatus of claim 1 wherein said means interconnected between said gear train means and said pusher means include:

a looped drive belt connected to and rotationally drivable by said gear train means, and means for coupling a portion of said drive belt to said pusher means.

4. The paper supply apparatus of claim wherein:

said holding means are operatively movable between a paper stack-receiving position and a paper stack-gripping position, and said shifting means further include means, interconnected between said gear train means and said holding means, for operatively moving said holding means in response to driven rotation of said gear train means.

5. The paper supply apparatus of claim 4 wherein said means interconnected between said gear train means and said holder means include:

a rotatably supported cam follower, cam means carried by said gear train means for engaging and rotationally driving said cam follower in response to driven rotation of said gear train means, and cable means interconnected between said cam follower and said holding means.

6. The paper supply apparatus of claim 1 wherein:

said bin-defining means include divider means projecting into opposite sides of the tray interior between said front and rear bin areas, said divider means being operatively movable between a first position in which they separate said front and rear paper stacks and act as a backstop for the front paper stack, and a second position in which they permit passage of said front paper stack into the empty front bin area, and said shifting means further include means for operatively moving said divider means in response to driven rotation of said gear train means.

7. The paper supply apparatus of claim 6 wherein said means for operatively moving said divider means include:

a rotatably supported cam follower, cam means carried by said gear train means for engaging and rotationally driving said cam follower in response to driven rotation of said gear train means, and pivotally supported means secured to said divider means and positioned to be engaged and pivoted by said cam follower in response to driven rotation of said gear train means.

8. Paper supply apparatus for supplying paper to an image reproduction machine having a housing, an opening formed in said housing, feed means operative to feed paper into said housing from a paper supply stack disposed adjacent said opening, and printing means for imprinting paper fed into said housing, said paper supply apparatus comprising:

a paper feed tray structure having front and rear ends and being forwardly insertable into said housing opening;

bin-defining means for defining in said paper feed tray structure front and rear bin areas respectively configured to receive and support front and rear stacks of cut paper sheets, said bin-defining means including:

divider means projecting into opposite sides of the tray interior between said front and rear bin areas, said divider means being operatively movable between a first position in which they separate said front and rear paper stacks and act as a backstop for the front paper stack, and a second position in which they permit passage of said front paper stack into the empty front bin area;

holding means, associated with said front bin area, for receiving the front paper sheet stack and gripping it in a manner facilitating the sequential infeed of its paper sheets into said machine by said feed means when said paper feed tray structure is inserted into said housing opening, said holding means including:

a base plate member adapted to underlie and support the front stack of cut paper sheets, said base plate member having a rear edge portion pivotally secured to a bottom rear portion of said front bin area, spring means for pivotally biasing said base plate member in an upward direction, and support tab means for overlying and engaging front edge portions of the front paper sheet stack;

pusher means, carried by a rear portion of said paper feed tray structure for operatively driven forward and rearward movement relative thereto between front and rear limit positions, for engaging the rear paper stack and pushing it into said front bin area; and shifting means for moving the rear paper stack into the front bin area when said front bin area is empty, said shifting means being operative to sequentially:

(1) downwardly pivot said base plate member against the bias of said spring means, (2) move said divider means from said first position thereof to said second position thereof, (3) move said pusher means from said rear limit position thereof to said front limit position thereof to push said rear paper stack into the empty front bin area, (4) return said divider means to said first position thereof and permit said spring means to upwardly pivot said base plate member to cause said support tab means to operatively engage front edge portions of the repositioned rear paper stack, and (5) return said pusher means to said rear limit position thereof to permit operative loading of a paper stack in the now empty rear bin area.

9. The paper supply apparatus of claim 8 wherein said shifting means include:

rotationally drivable gear train means carried by said paper feed tray structure, motor means for rotationally driving said gear train means, first means interconnected between said gear train means and said pusher means for operatively moving said pusher means in response to driven rotation of said gear train means, second means interconnected between said gear train means and said base plate member for operatively pivoting said base plate member in response to driven rotation of said gear train means, and third means interconnected between said gear train means and said divider means for operatively moving said divider means in response to driven rotation of said gear train means.

10. The paper supply apparatus of claim 9 wherein:

said motor means and said gear train means are disposed beneath said rear bin area of said paper tray structure.

11. The paper supply apparatus of claim 9 wherein said first means include:

a looped drive belt connected to and rotationally drivable by said gear train means, and means for coupling a portion of said drive belt to said pusher means.

12. The paper supply apparatus of claim 9 wherein said second means include:

a rotatably supported cam follower, cam means carried by said gear train means for engaging and rotationally driving said cam follower in response to driven rotation of said gear train means, and cable means interconnected between said cam follower and said base plate member.

13. The paper supply apparatus of claim 9 wherein said third means include:

a rotatably supported cam follower, cam means carried by said gear train means for engaging and rotationally driving said cam follower in response to driven rotation of said gear train means, and pivotally supported means secured to said divider means and positioned to be engaged and pivoted by said cam follower in response to driven rotation of said gear train means.

14. The paper supply apparatus of claim 13 wherein:

said second means are operatively interconnected between said cam follower and said base plate member.

15. The paper supply apparatus of claim 9 further comprising:

lost motion means, interconnected between said gear train means and said first means, for permitting operative driving force to be transmitted from said gear train means to said first means during only a portion of the overall driven rotational motion of said gear train means.

* * * * *

UNITED STATES PATENT AND TRADEMARK OFFICE

CERTIFICATE OF CORRECTION

PATENT NO. : 5,163,670

DATED : November 17, 1992

INVENTOR(S) : Charles A. Sellers; David P. Eichberger; Steven J. Lau; Mark H. Ruch; Nicholas G. Forlenza; Roger Q. Paulsel

It is certified that error appears in the above-identified patent and that said Letters Patent is hereby corrected as shown below:

Column 3, line 53, "FIG." should be --FIG. 1--.

Column 4, line 30, "FIGS. and 2," should be --FIGS. 1 and 2,--.

Column 8, lines 8-9, "be 20 described" should be --be described--.

Column 15, line 54, "claim" should be --claim 1--.

Signed and Sealed this

Fourth Day of January, 1994

*Attest:*

Bruce Lehman

BRUCE LEHMAN

*Attesting Officer*

*Commissioner of Patents and Trademarks*